343-700 MS AJ 256 EX
6/13/78 OR 4,095,227

United States Patent [19]
Kaloi

[11] 4,095,227
[45] * June 13, 1978

[54] ASYMMETRICALLY FED MAGNETIC MICROSTRIP DIPOLE ANTENNA

[75] Inventor: Cyril M. Kaloi, Thousand Oaks, Calif.

[73] Assignee: The United States of America as represented by the Secretary of the Navy, Washington, D.C.

[ * ] Notice: The portion of the term of this patent subsequent to Jul. 27, 1993, has been disclaimed.

[21] Appl. No.: 740,695

[22] Filed: Nov. 10, 1976

[51] Int. Cl.² ..... H01Q 1/38
[52] U.S. Cl. ..... 343/700 MS; 343/845
[58] Field of Search ..... 343/700 MS, 705, 708, 343/829, 846, 845

[56] References Cited

U.S. PATENT DOCUMENTS

| | | | |
|---|---|---|---|
| 3,346,865 | 10/1967 | Jones | 343/708 |
| 3,541,557 | 11/1970 | Miley | 343/708 |
| 3,972,049 | 7/1976 | Kaloi | 343/829 |

FOREIGN PATENT DOCUMENTS

| | | | |
|---|---|---|---|
| 1,050,583 | 1/1954 | France | 343/705 |

*Primary Examiner*—Eli Lieberman
*Attorney, Agent, or Firm*—Richard S. Sciascia; Joseph M. St.Amand

[57] ABSTRACT

An asymmetrically fed magnetic microstrip dipole antenna consisting of a thin electrically conducting, rectangular-shaped radiating element formed on one surface of a dielectric substrate, the ground plane being on the opposite surface with the radiating element shorted to the ground plane. The length of the element determines the resonant frequency. The feed point is located along the centerline of the antenna length and the input impedance can be varied by moving the feed point along the centerline from the center point to the end of the antenna without affecting the radiation pattern. The antenna bandwidth increases with the width of the element and spacing between the element and ground plane. The element is shorted through the dielectric to the ground plane with rivets or plated-through holes at one end of the element length.

10 Claims, 14 Drawing Figures

ASYMMETRICALLY FED MAGNETIC MICROSTRIP DIPOLE ANTENNA

This invention is related to U.S. Pat. No. 3,972,049 issued July 27, 1976 for ASYMMETRICALLY FED ELECTRIC MICROSTRIP DIPOLE ANTENNA, by Cyril M. Kaloi and commonly assigned.

This invention is also related to copending U.S. patent applications:

- Ser. No. 740,697 for NOTCH FED MAGNETIC MICROSTRIP DIPOLE ANTENNA, now U.S. Pat. No. 4,040,060;
- Ser. No. 740,693 for OFFSET FED MAGNETIC MICROSTRIP DIPOLE ANTENNA;
- Ser. No. 740,691 for COUPLED FED MAGNETIC MICROSTRIP DIPOLE ANTENNA;
- Ser. No. 740,694 for ELECTRIC MONOMICROSTRIP DIPOLE ANTENNAS;
- Ser. No. 740,690 for TWIN ELECTRIC MICROSTRIP DIPOLE ANTENNAS;
- Ser. No. 740,696 for NOTCHED/DIAGONALLY FED ELECTRIC MICROSTRIP DIPOLE ANTENNA, now Pat. No. 4,051,478; and
- Ser. No. 740,692 for CIRCULARLY POLARIZED ELECTRIC MICROSTRIP ANTENNAS;

all filed together herewith on Nov. 10, 1976, by Cyril M. Kaloi, and commonly assigned.

The present invention is related to antennas and more particularly to microstrip antennas, especially low profile microstrip antennas that can be arrayed to provide near isotropic radiation patterns.

SUMMARY OF THE INVENTION

The present antenna is one of a family of new microstrip antennas. The specific type of microstrip antenna described herein is the "asymmetrically fed magnetic microstrip dipole." Reference is made to the "magnetic microstrip dipole" instead of simply the "microstrip dipole" to differentiate between two basic types; one being the magnetic microstrip type, and the other being the electric microstrip type. The asymmetrically fed magnetic microstrip dipole antenna belongs to the magnetic microstrip type antenna. The magnetic microstrip antenna consists essentially of a conducting strip called the radiating element and a conducting ground plane separated by a dielectric substrate, with the radiating element having one end shorted to the ground plane. The shorting of the radiating element to the ground plane can be accomplished by electroplating through a series of holes or by means of rivets. The length of the radiating element is approximately ¼ wavelength. The width can be varied depending on the desired electrical characteristics. The conducting ground plane is usually greater in length and width than the radiating element.

The magnetic microstrip antenna's physical properties are somewhat similar to those of the electric microstrip antenna, except that the radiating element is approximately ¼ wavelength in length whereas the electric microstrip antenna is ½ wavelength in length, for the same frequency, and the radiating element has one end shorted to ground in the magnetic microstrip antenna. However, the electrical characteristics of the magnetic microstrip antenna are quite different from the electric microstrip antenna, as will be hereinafter shown.

The thickness of the dielectric substrate in the magnetic microstrip antenna should be much less than ¼ the wavelength. For thickness approaching ¼ the wavelength, the antenna radiates in a monopole mode in addition to radiating in a microstrip mode.

The antenna as hereinafter described can be used in missiles, aircraft and other type applications where a low physical profile antenna is desired. The present antenna structure is readily formed from conductor clad dielectric substrate using conventional photo-etching processes similar to those used in manufacturing printed circuits. The asymmetrically fed magnetic microstrip antenna element provides completely different radiation patterns and can be arrayed to provide near isotropic radiation patterns for telemetry, radar, beacons, tracking, etc. By arraying the present antenna with several elements, more flexibility in forming radiation patterns is permitted. In addition, the antenna can be designed for any desired frequency within a limited bandwidth, preferably below 25 GHz, since other types of antennas can give better antenna properties above 25 GHz, for most commonly used stripline materials. The antenna of this invention is particularly suited to receive and radiate electromagnetic energy in the 1435–1535 MHz and the 2200–2290 MHz bands. The design technique used for this antenna provides an antenna with ruggedness, simplicity, low cost, a low physical profile, and conformal arraying capability about the body of a missile or vehicle where used including irregular surfaces, while giving excellent radiation coverage. The antenna can be arrayed over an exterior surface without protruding, and be thin enough not to affect the airfoil or body design of the vehicle. The thickness of the present antenna can be held to an extreme minimum depending upon the bandwidth requirement; antennas as thin as 0.005 inch for frequencies above 1,000 MHz have been successfully produced. Due to its conformability, this antenna can be applied readily as a wrap around band to a missile body without the need for drilling or injuring the body and without interfering with the aerodynamic design of the missile. In the present type antenna, it is necessry to ground the antenna element to the ground plane. Further, the antenna can be easily matched to most practical impedances by varying the location of the feed point along the length of the element.

Advantages of the antenna of this type over other similar appearing types of microstrip antennas is that the present antenna can be fed very easily from the ground plane side and has a slightly wider bandwidth for the same form factor.

The asymmetrically fed magnetic microstrip dipole antenna consists of a thin, electrically-conducting rectangular-shaped element formed on the surface of a dielectric substrate; the ground plane is on the opposite side of the dielectric substrate with one end of the element length shorted to the ground plane. The microstrip antenna element is fed from a coaxial-to-microstrip adapter, with the center pin of the adapter extending through the ground plane and dielectric substrate to the feed point of the element. The length of the antenna element determines the resonant frequency. The feed point is located along the centerline of the antenna length. While the input impedance will vary as the feed point is moved along the centerline between the antenna center point and the end of the antenna in either direction, the radiation pattern will not be affected by moving the feed point. The antenna bandwidth increases with the width of the element and the spacing (i.e., thickness of dielectric) between the ground plane and the element; the spacing has a somewhat greater effect on the bandwidth than the element width. The radiation pattern changes very little within the bandwidth of operation.

Design equations sufficiently accurate to specify a few of the design properties of the asymmetrically fed magnetic dipole antenna are discussed later. These design properties are the input impedance, the bandwidth, the efficiency, radiation resistance, and the antenna element dimensions as a function of the frequency. Calculations have been made using these equations, and typical asymmetrically fed magnetic microstrip dipole antennas have been built using the calculated results. The design properties such as the gain, the polarization, and the radiation pattern entail a more complex solution of the field equation and therefore are not included. However, actual measurements of the fields, gain and polarization have been made.

DESCRIPTION AND OPERATION

Figure 1A:
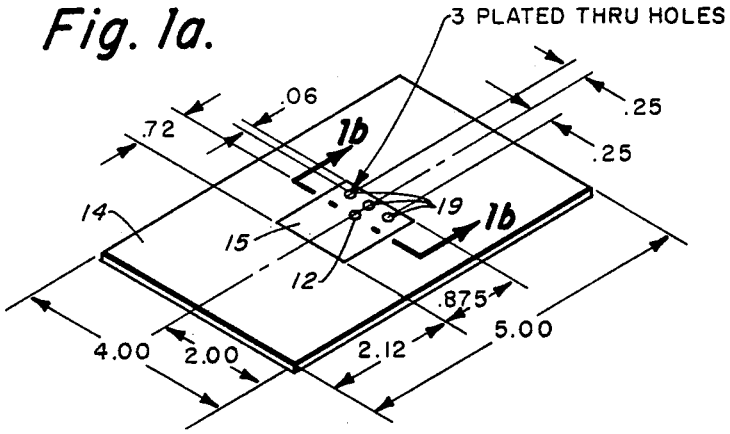
FIG. 1*a* is an isometric planar view of a typical square asymmetrically fed magnetic microstrip dipole antenna.
Figure 1B:
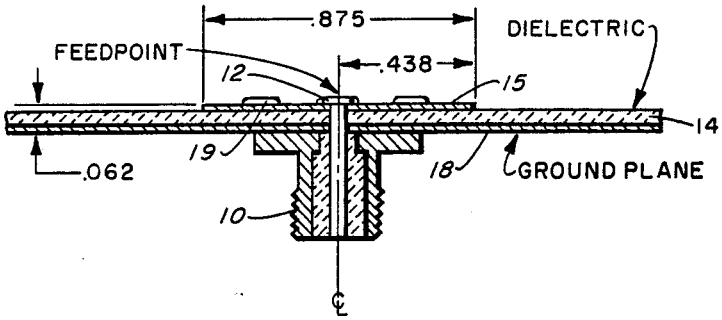
FIG. 1*b* is a cross-sectional view taken along section line B—B of FIG. 1*a*.
Figure 2:
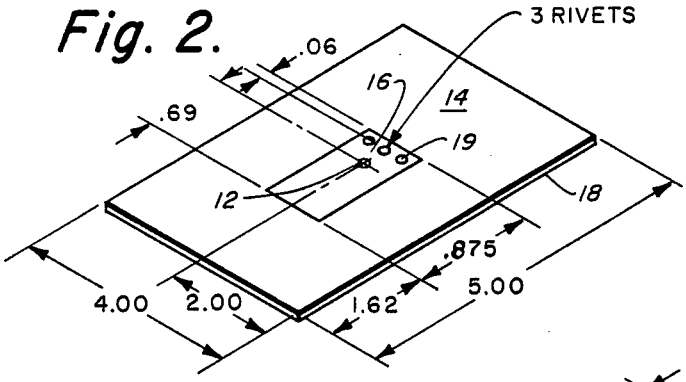
FIG. 2 is an isometric planar view of a typical rectangular asymmetrically fed magnetic microstrip dipole antenna where the width is less than the length.
Figure 3:
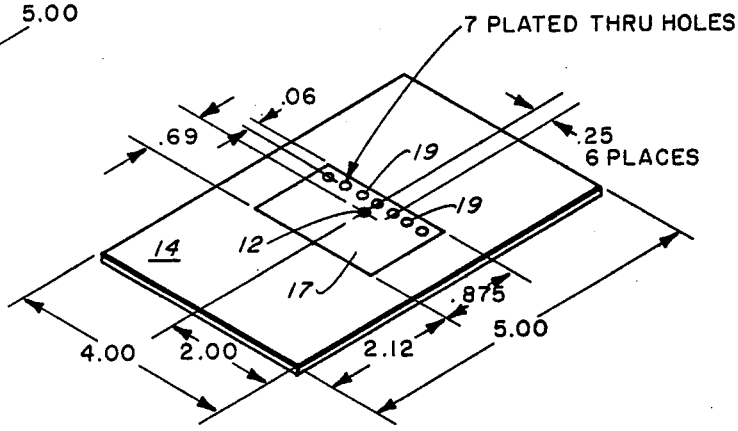
FIG. 3 is an isometric planar view of a typical rectangular asymmetrically fed magnetic microstrip dipole antenna where the width is greater than the length.

FIGS. 1*a* and 1*b* show a typical square asymmetrically fed magnetic microstrip dipole antenna of the present invention. FIGS. 2 and 3 show rectangular asymmetrically fed magnetic microstrip dipole antennas. The only physical differences in the above antennas are the element width and the location of the feed point. In FIG. 2, the width of the radiating element is less than the length, and in FIG. 3, the width is greater than the length. The thickness of the antennas shown in FIGS. 2 and 3 is the same as shown in FIG. 1*b*. The electrical differences are that the wider antenna element has a slightly greater bandwidth, and for the same length, the center frequency increases as the width decreases. Three typical antennas are illustrated with the dimensions given (in inches), as shown in FIGS. 1*a* and 1*b*, 2, and 3, by way of example, and the curves shown in later figures are for the typical examples of antennas illustrated in FIGS. 1*a* and 1*b*, and FIG. 3. The antenna is fed from a coaxial-to-microstrip adapter 10, with the center pin 12 of the adapter extending through the dielectric substrate 14 and to the feed point on microstrip element 15, 16 or 17. The microstrip antenna can be fed with most of the different types of coaxial-to-microstrip launchers presently available. The dielectric substrate 14 separates the element 16 or 17 from the ground plane 18 electrically. The element is shorted to ground plane 18 by means of rivets or plated-through holes 18 similar to those used in printed circuitry.

Figure 4A:
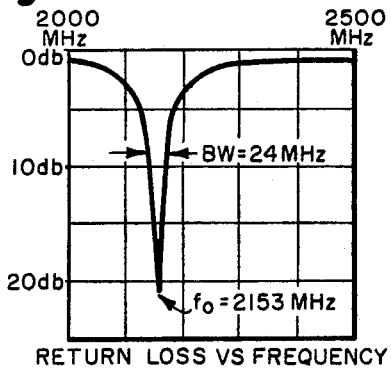
FIG. 4*a* is a plot showing the return loss versus frequency for a square element antenna having the dimensions shown in FIGS. 1*a* and 1*b*.
Figure 4B:
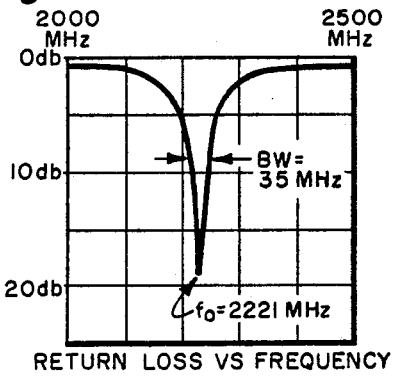
FIG. 4*b* is a plot showing the return loss versus frequency for a rectangular element antenna having the dimensions as shown in FIG. 3.

FIGS. 4*a* and 4*b* show plots of return loss versus frequency (which are indications of bandwidth) for the square element 15 and rectangular element 17, respectively. The copper losses in the clad material determine how narrow the element can be made. The length of the element determines the resonant frequency of the antenna. It is preferred that both the length and the width of the ground plane be at least one wavelength ($\lambda$) in dimension beyond each edge of the element to minimize backlobe radiation.

As shown by the dimensions given in FIGS. 1*a*, 2 and 3, the feedpoint 12 is located nearer the shorted end of elements 15, 16 and 17, respectively. FIGS. 4*a* and 4*b*, which show respective return loss vs. frequency for the elements of FIGS. 1*a* and 3, indicate a good impedance match. The asymmetrically fed magnetic microstrip dipole antenna is fed along the centerline between the shorted end and opposite end of the antenna and when the feedpoint is located closer to the shorted end of the element, as shown in the examples of FIGS. 1*a*, 2 and 3, a better impedance match is obtained. However, if any of elements 15, 16 or 17 are fed at the very end opposite to the shorted end, as further described below with regard to FIG. 10, an antenna so fed no longer is the asymmetrically fed type microstrip antenna, but becomes an end fed antenna which requires a high input impedance matching network.

Figure 5:
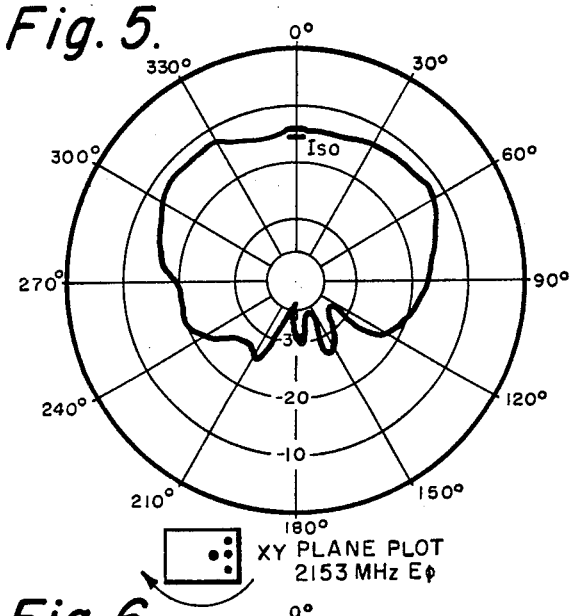
FIG. 5 shows the antenna radiation pattern (XY-plane plot) for the square element antenna shown in FIGS. 1*a* and 1*b*.
Figure 7:
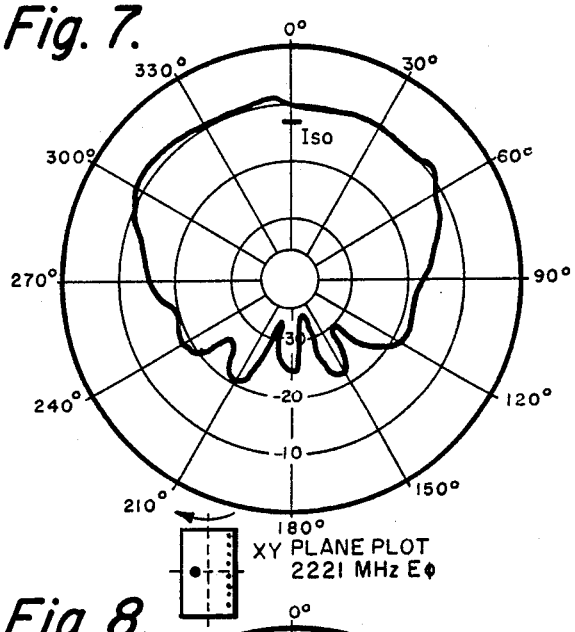
FIG. 7 shows the antenna radiation pattern (XY-plane plot) for the rectangular element antenna shown in FIG. 3.
Figure 6:
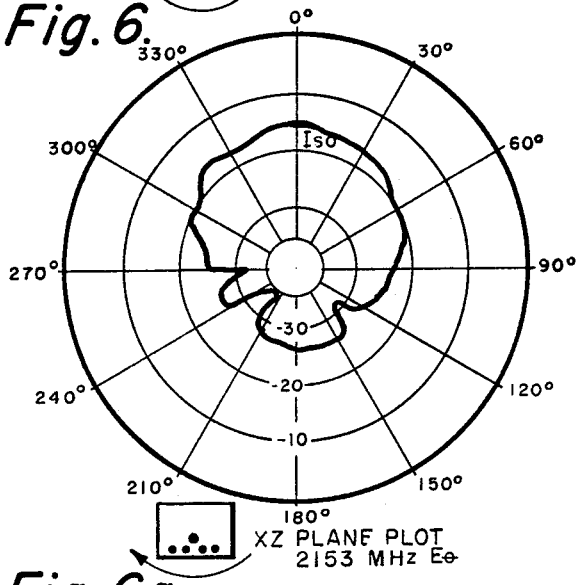
FIG. 6 shows the antenna radiation pattern (XZ-plane plot) for the square element antenna shown in FIGS. 1*a* and 1*b*.
Figure 8:
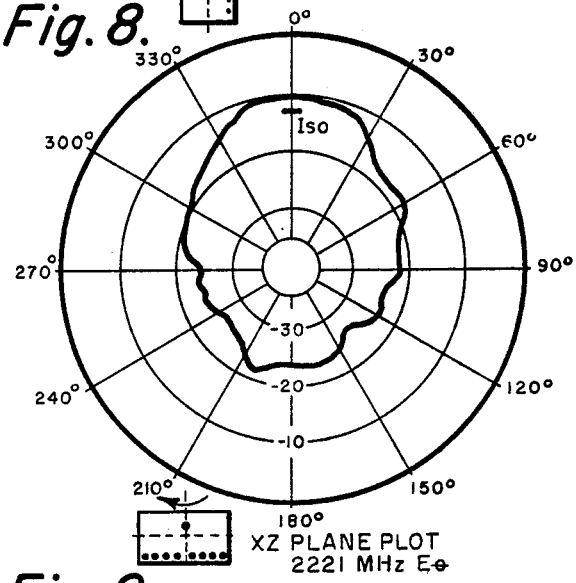
FIG. 8 shows the antenna radiation pattern (XZ-plane plot) for the rectangular element antenna shown in FIG. 3.
Figure 6A:
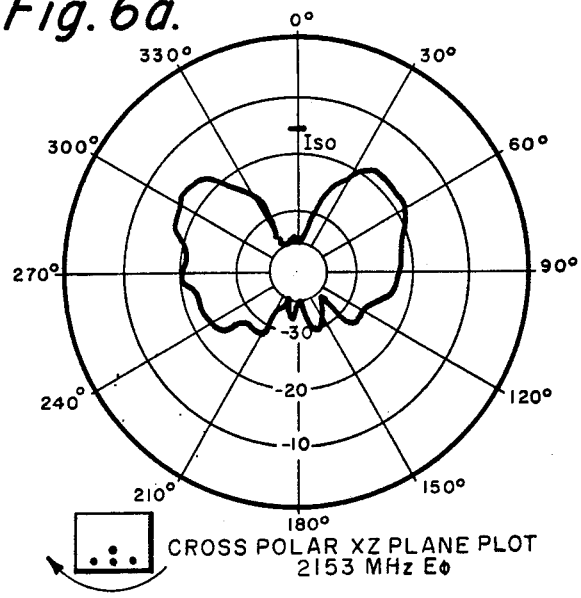
FIG. 6*a* shows the antenna radiation pattern (XZ-plane cross polarization plot) for the square element in FIGS. 1*a* and 1*b*.
Figure 8A:
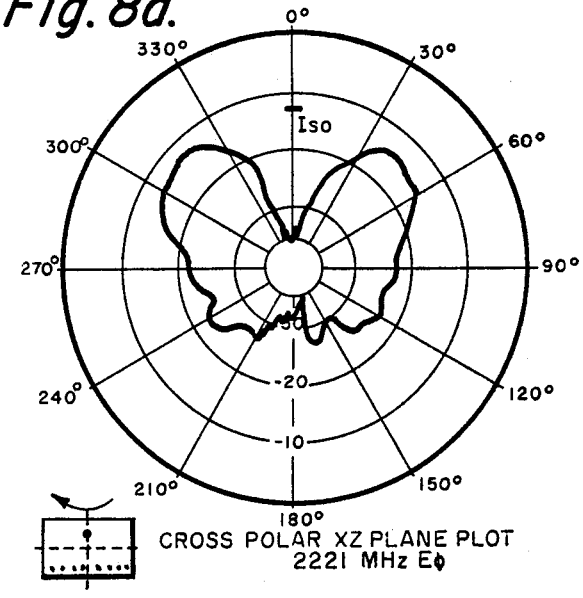
FIG. 8*a* shows the antenna radiation pattern (XZ-plane cross polarization plot) for the rectangular element of FIG. 3.

FIGS. 5, 6 and 6*a* show antenna radiation patterns for the square element of FIGS. 1*a* and 1*b*. FIGS. 7, 8 and 8*a* show similar patterns for the rectangular element of FIGS. 2 and 3. Cross-polarization energy in the XY plane is minimal and is therefore not included.

The asymmetrically fed antenna can be made narrower than a square, such as element 16, shown in FIG. 2, and is limited in how narrow it can be only by the losses (i.e., copper and dielectric losses) involved.

Figure 10:
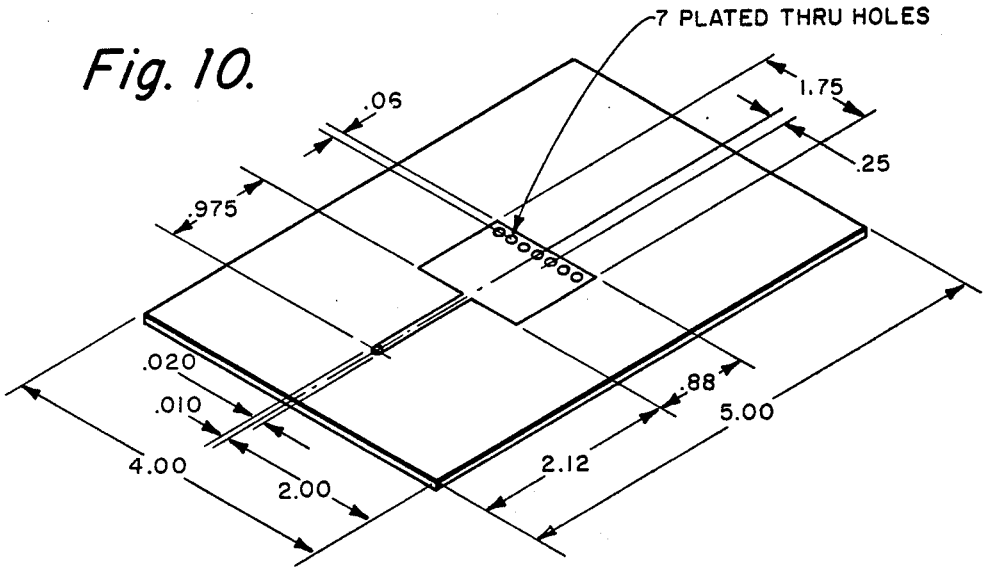
FIG. 10 is an isometric planar view of a typical end fed magnetic microstrip antenna.

If a rectangular antenna element is fed at the end of the element length on the centerline, a matching transmission line will be required since the input impedance will be very high for most practical microstrip antennas. The antenna when fed in this manner becomes an end fed microstrip antenna. An example is shown in FIG. 10 of an end fed magnetic microstrip antenna. This type antenna allows for arraying of the elements with microstrip transmission line. However, due to the high input impedance a matching network is required to obtain, for example, a nominal 50 ohm impedance match.

Pertinent design equations sufficient to characterize the asymmetrically fed magnetic microstrip antenna are discussed below.

Design Equations

To a system designer, the properties of an antenna most often required are the input impedance, gain, bandwidth, efficiency, polarization, and radiation pattern. The antenna designer needs to know the above-mentioned properties and also the antenna element dimension as a function of frequency.

Figure 9:
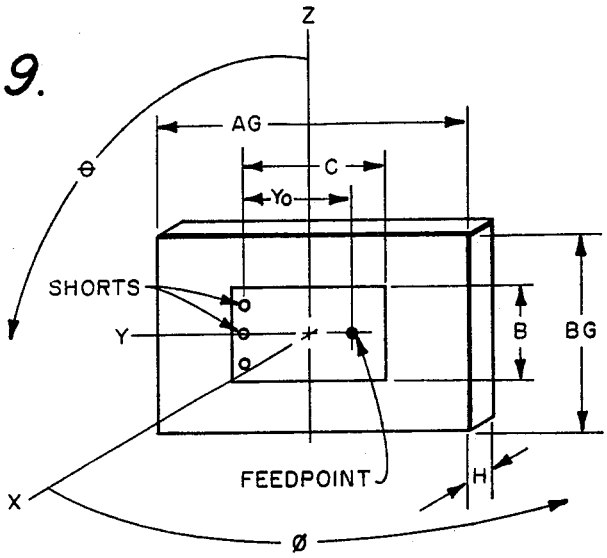
FIG. 9 illustrates the alignment coordinate system used for the asymmetrically fed magnetic microstrip dipole antenna.

The coordinate system used and the alignment of the antenna element within this coordinate system are shown in FIG. 9. The coordinate system is in accordance with the IRIG Standards and the alignment of the antenna element was made to coincide with the actual antenna patterns that were shown earlier. The B dimension is the width of the antenna element. The C dimension is the effective length of the antenna element and is measured from the short to the opposite end. The H dimension is the height of the antenna element above the ground plane and also the thickness of the dielectric. The AG dimension and the BG dimension are the length and the width of the ground plane, respectively. The $Y_o$ dimension is the location of the feed point measured along the centerline from the point the element is shorted to ground, as shown. The angle $\theta$ and $\phi$ are measured per IRIG Standards. The above parameters are measured in inches and degrees.

Antenna ELEMENT Dimension

The equation for determining the length, *C*, of the antenna element is given by $$C = \frac{[1.18 \times 10^{10} - F \times 4 \times H \times \sqrt{\epsilon}]}{\left[4 \times F \times \sqrt{1 + 0.61 \times (\epsilon - 1) \times \left(\frac{B}{H}\right)^{0.1155}}\right]}$$

where $x$ = indicates multiplication $F$ = center frequency (Hz)

$\epsilon$ = the dielectric constant of the substrate (no units).

In most practical applications, B, F, H, and $\epsilon$ are usually given. However, it is sometimes desirable to specify B as a function of C as in a square element. As seen from equation for C, a closed form solution is not possible for the square element. However, numerical solution can be accomplished by using Newton's Method of successive approximation (see U.S. National Bureau of Standards, Handbook Mathematical Functions, Applied Mathematics Series 55, Washington, D.C., GPO, Nov. 1964) for solving the equation in terms of B when B is a function of C. The equation for C is obtained by fitting curves to Sobol's equation (Sobol. H. "Extending IC Technology to Microwave Equipment," ELECTRONICS, Vol. 40, No. 6 (20 Mar 1967), pp. 112–124). The modification was needed to account for end effects when the microstrip transmission line is used as an antenna element. Sobol obtained his equation by fitting curves to Wheeler's conformal mapping analysis (Wheeler, H. "Transmission Line Properties of Parallel Strips Separated by a Dielectric Sheet," IEEE TRANSACTIONS, Microwave Theory Technique, Vol. MTT-13, No. 2, Mar 1965, pp. 172–185).

As was indicated, the length C of the antenna radiating element is that dimension measured from the short (i.e., the center of the rivets or plated-through holes) to the opposite end of the element, as shown in FIG. 9. The number and spacing of the shorting rivets or plated-through holes can be varied without affecting the proper operation of the antenna. The more shorts along the short line, however, the greater will be the accuracy of the equation for the length, C. More or less shorts than shown in the figures of drawing can be used; the number shown in the drawings, however, operate very satisfactorily. The rivets and plated-through holes are similar to those used in printed circuits.

The grounding rivets or plated-through holes operate effectively for shorting the radiating element to the ground plane, as shown in the drawings. The size of the rivet or plated-through holes can be varied. However, as the diameter of the rivet or plated-through hole is increased, this will shorten the effective length of the radiating element, thereby increasing the center frequency. Conversely, decreasing the diameter will increase the effective length of the radiating element and thereby decrease the center frequency of the antenna. The rivets or plated-through holes are normally close to the edge of the shorted end of the antenna element. As long as the distance between the rivet or plated-through hole and the shorted end of the element strip is a very small fraction of the wavelength, the operation of the antenna will not be affected.

Derivation of design equations mentioned earlier requires having an expression for the $E_\theta^2$ and $E_\phi^2$ power fields. The $E_\theta$ field and the $E_\phi$ field for the "asymmetrically fed magnetic microstrip dipole antenna" are very complex. The reasons are that five modes of oscillating dipole moment alignment occur on the element. These oscillating dipole moments occur between the edges of the element and the ground plane along the four edges, in addition to the oscillating dipole moments broadside to the element. A single current oscillation mode in the cavity between the radiating element and the ground plane contributes to the five dipole moments of oscillation.

It has been shown that if only one oscillating "cavity current" mode takes place, as in this antenna, the radiation resistance for the element may be derived by assuming that all the power occurs in one oscillating dipole moment mode, since the radiation resistance, $R_a$, is given by the total radiated power, W, divided by the effective oscillating cavity current $I_{eff}$. Although this technique does not give an accurate calculated shape of the radiation pattern, the gain or the polarization of the antenna element, it does provide the total power radiated. The total power radiated is all that is required to determine the other antenna properties such as input impedance, bandwidth and efficiency. The exact fields, antenna gain, and polarization can be obtained by actual measurements, as shown in FIGS. 5, 6, 6*a*, 7, 8, and 8*a*, and therefore equations for these properties are not absolutely required. However, if it is desired to obtain equations for the fields, all five oscillating dipole moments mode must be taken into consideration.

If one assumes that all the power occurs in the "dipole moment mode" broadside to the element, by virtue of the image principle, one can proceed to derive the equations of radiation resistance, input impedance, bandwidth and efficiency in the same manner as was derived for "Asymmetrically Fed Electric Microstrip Dipole Antenna" in aforementioned U.S. Pat. No. 3,972,049. The antenna element length, C, as a function of frequency, $f$, was derived earlier. However, upon invoking the image principle, the length for the element used in computations for the asymmetrically fed magnetic microstrip antennas must be double. By letting $$A = 2C$$

where $A$ is the length of the element plus the image length, and having calculated the total power radiated, the properties mentioned above can be computed for this antenna. Equations for the radiation resistance, input impedance, efficiency, and bandwidth given in aforementioned U.S. Pat. No. 3,972,049 can be used to provide reasonably accurate results for the asymmetrically fed magnetic microstrip dipole antenna, keeping in mind that $A = 2C$ in these equations.

Typical antennas have been built using the aforementioned equations and the calculated results are in good agreement with test results.

The magnetic microstrip antennas involve major differences in electrical characteristics when compared to the electric microstrip antennas. This is particularly true as to radiation pattern configurations and for location of the feed points for different input matching conditions. Further, the magnetic microstrip antennas are susceptible to complex polarization, which are desirable under certain circumstances.

These complex polarization patterns give a half-donut configuration in the YZ plane completely around the antenna. In addition, in the XY plane, there is provided a pattern broadside to the element (i.e., above the ground plane).

Obviously many modifications and variations of the present invention are possible in light of the above teachings. It is therefore to be understood that within the scope of the appended claims the invention may be practiced otherwise than as specifically described.

What is claimed is:

1. An asymmetrically fed magnetic microstrip dipole antenna having low physical profile and conformal arraying capability, comprising:

a. a thin ground plane conductor;

b. a thin rectangular radiating element spaced from said ground plane;

c. said radiating element being electrically separated from said ground plane by a dielectric substrate;

d. said radiating element being shorted to the ground plane at one end of the length thereof;

e. said radiating element having a feedpoint located between the shorted end and opposite end of the element along the centerline of the length thereof;

f. said radiating element being fed from a coaxial-to-microstrip adapter, the center pin of said adapter extending through said ground plane and dielectric substrate to said radiating element;

g. the length of said radiating element determining the resonant frequency of said antenna;

h. the antenna input impedance being variable to match most practical impedances as said feedpoint is moved moved along said centerline between the antenna radiating element center point and the end of the radiating element in either direction without affecting the antenna radiation pattern;

i. the antenna bandwidth being variable with the width of the radiating element and the spacing between said radiating element and said ground plane, said spacing between the radiating element and the ground plane having somewhat greater effect on the bandwidth than the element width;

j. optimum match for the resonant mode of oscillation being obtained by varying the location of said feed point along the element edge.

2. An antenna as in claim 1 wherein the ground plane conductor extends at least one wavelength beyond each edge of the radiating element to minimize any possible backlobe radiation.

3. An antenna as in claim 1 wherein a plurality of said radiating elements are arrayed to provide a near isotropic radiation pattern.

4. An antenna as in claim 1 wherein the length of said radiating element is approximately ¼ wavelength.

5. An antenna as in claim 1 wherein said radiating element is shorted to the ground plane by means of any of rivets and plated-through holes.

6. An antenna as in claim 1 wherein a plurality of said thin rectangular radiating elements are arrayed on one surface of the dielectric substrate over a single ground plane.

7. An antenna as in claim 1 wherein the length of said antenna radiating element is determined by the equation:

$$C = \frac{[1.18 \times 10^{10} - F \times 4 \times H \times \sqrt{\epsilon}]}{\left[4 \times F \times \sqrt{1 + 0.61 \times (\epsilon - 1) \times \left(\frac{B}{H}\right)^{0.1155}}\right]}$$

where $C$ is the length to be determined $F$ = the center frequency (Hz)

$B$ = the width of the antenna element $H$ = the thickness of the dielectric $\epsilon$ = the dielectric constant of the substrate.

8. An antenna as in claim 1 wherein said radiating element oscillates in five oscillating dipole moments, one at each of the four edges of said element and one above the broadside surface of the element, the oscillation along the four edges of the element occurring between the element and the ground plane and the oscillation above the broadside surface of the element occurring along the length of the element.

9. An antenna as in claim 1 wherein the minimum width of said radiating element is determined by the equivalent internal resistance of the conductor plus any loss due to the dielectric.

10. An antenna as in claim 1 wherein said feedpoint is preferably located nearer to the shorted end of said radiating element than to the non-shorted end thereof.

* * * * *